United States Patent [19]

Ginther, Sr. et al.

[11] 4,273,322

[45] Jun. 16, 1981

[54] GATE MECHANISM FOR CARTON ERECTING MACHINE

[75] Inventors: George E. Ginther, Sr., King of Prussia; A. David Johnson, Jr.; Joseph L. Bachman, both of Wayne, all of Pa.

[73] Assignee: Wayne Automation Corporation, King of Prussia, Pa.

[21] Appl. No.: 55,764

[22] Filed: Jul. 9, 1979

[51] Int. Cl.[3] ..... B31B 1/06

[52] U.S. Cl. ..... 271/149; 271/30 A; 493/122

[58] Field of Search ..... 93/53 R, 53 SD; 53/564; 271/30 A, 104, 149, 150, 169, 170; 493/122, 309

[56] References Cited

U.S. PATENT DOCUMENTS 2,291,010 7/1942 Vergobbi ..... 93/53 R

*Primary Examiner*—James F. Coan

*Attorney, Agent, or Firm*—Frederick J. Olsson

[57] ABSTRACT

Gate has two carton restrainers. First restrainer holds the lead carton in magazine stack while the second is inoperative. For take-down of the lead carton, first restrainer is moved away while at the same time the second restrainer engages and holds the carton next to the lead carton to prevent the same (and the cartons behind it) from popping out of the gate.

5 Claims, 4 Drawing Figures

GATE MECHANISM FOR CARTON ERECTING MACHINE

This invention relates to case or carton erecting machines; i.e. machines for taking flat folded cases or cartons and erecting the same whereby the bottom flaps can be glued or stapled to condition the carton for accepting items or materials to be shipped therein.

More specifically, the invention relates to a magazine gate for a carton erecting machine. The gate has a pair of carton restrainers operating to oppositely engage and disengage the stack in a manner to guarantee speedy and proper take-down.

The first restrainer positions and restrains the lead carton in the take-down plane while the second restrainer is inoperative, then the first restrainer frees the lead carton for the take-down operation while at the same time the second restrainer engages the stack and prevents the carton behind the lead carton from popping thru the gate into the erection mechanism.

The invention has several distinct advantages:

(a) The lead carton is always positioned in the take-down plane so that there is no need to pause the suction cups against the lead carton with consequent saving in operating time and this provides for carton erection rate to be greatly increased. For example, on an erecting machine with conventional gate mechanism, the rate may be about 20 cartons per minute but with gate of the invention the rate can be increased to 25–30 per minute.

(b) During a magazine reloading operation, the attendant cannot push the lead carton (and others) thru the gate. This eliminates machine jam-up and the down time for correction of same.

(c) The take-down operation includes the lead carton only. This eliminates machime jam-ups and the down time for correction where the second carton goes along with the lead carton into the erecting mechanism.

(d) The gate positively holds the lead carton in the take-down plane irrespective of the magnitude of the stack feed pressure. The fact that the force available to move the stack is greater as the stack get smaller (less stack friction) is of no consequence. Thus, the invention eliminates the conventional adjustments to prevent the increase in stack pressure from blowing the cartons thru the take-down station during the take-down operation.

The invention will be explained below in connection with the following drawings wherein.

Figure 1:
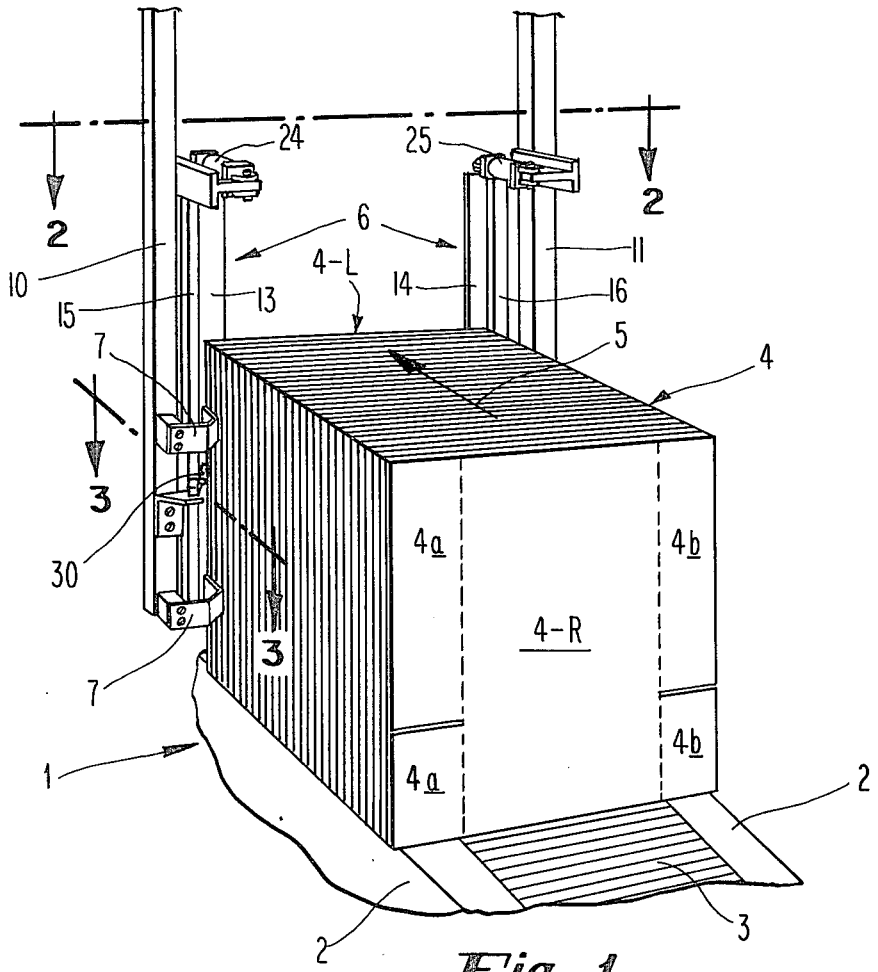
FIG. 1 is fragmentary perspective view of a carton erection magazine (with parts omitted) embodying the invention.

A machine for erecting flat folded cases or cartons is diagramatically illustrated in copending application Ser. No. 711,166 of Joseph L. Bachman et. al filed Feb. 23, 1977.

Typically, carton erecting machines comprise a magazine section and an erecting section mounted on common framing. The magazine section conventionally comprises a carrier belt which supports a stack of vertically oriented cartons between a take-down station and a pressure plate, the carrier and plate cooperating to move the cartons into the take-down station where they are taken down for the erection operation. Normally, the magazine will include means to guide the cartons into the take-down station. The typical magazine has disadvantages which the present invention eliminates namely: inability to place each lead carton entering the take-down station in exactly in the same position or in the same take-down plane; inability to ensure that when the attendent is re-loading the magazine (while the machine is operating) the lead carton will not be forced thru the take-down station and into the erection mechanism; the inability to insure that the take-down operation will remove only the lead carton (and not one or more cartons behind it) from feeding into the erection mechanism; and the necessity for adjusting stack feed pressure.

The machine framing supports a magazine including fixed platform 2 and a carrier belt 3 raised slightly above the platform and which mounts a stack of cartons 4. The cartons are vertically oriented as noted for the rear carton 4-R and the flaps extend on opposite sides as illustrated by the bottom flaps 4*a* and top flaps 4*b*.

A pressure plate (not shown) is adapted to engage the rear carton 4-R and push the stack in the forward direction (arrow 5) toward the take-down station generally indicated at 6 where the lead carton 4-L is vertically aligned in the take-down plane. The operation of the pressure plate and carrier belt 2 are coordinated so that the cartons are moved one by one into the take-down station.

Guide means 7 mounted on the upright 10 of the machine frame and similar guides on the upright 11 guide the cartons and ensure that the lead carton is in the correct lateral position as it enters the take-down plane.

Figure 2:
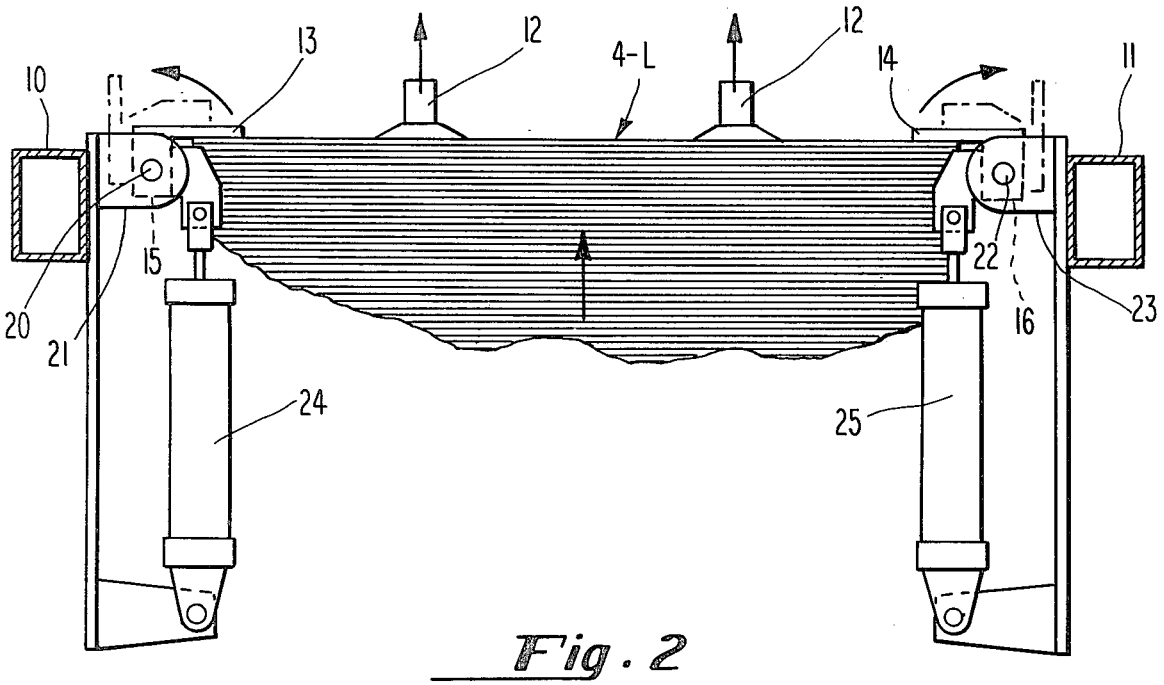
FIG. 2 is a plan view taken along the lines 2—2 of FIG. 1.

Conventionally, the lead carton is taken down or removed from the stack by suction cups such as noted at 12 in FIG. 2 and in the above mentioned application Ser. No. 711,116. The operation of the suction cups is coordinated with the operation of the pressure plate and carrier belt so that the carrier is stationary and the pressure plate is not exerting a forward thrust at the time of the take-down operation.

The gate mechanism of the invention is employed at the take-down station to releasably position the lead carton in a fixed take-down plane for the take-down operation or the start of the erection process.

The gate has a first pair of spaced apart restrainer means or vertically extending plates 13 and 14 disposed on opposite sides of the stack of cartons and which are adapted to rotate about vertical axes.

The plate 13 is connected to a vertical bar 15 and the plate 14 is connected to vertical bar 16. At the top, the bar 15 has a pivot 20 (FIG. 2) mounted in a bracket 21 fixed to upright 10. Also at the top, the bar 16 has a pivot 22 mounted in a bracket 23 fixed to upright 11. Similiar pivots and brackets connect the bottom of the bars to the upright 10 and 11. Thus, the plates 13 and 14 are mounted for rotation about the vertical axes formed by the pivots.

Figure 3:
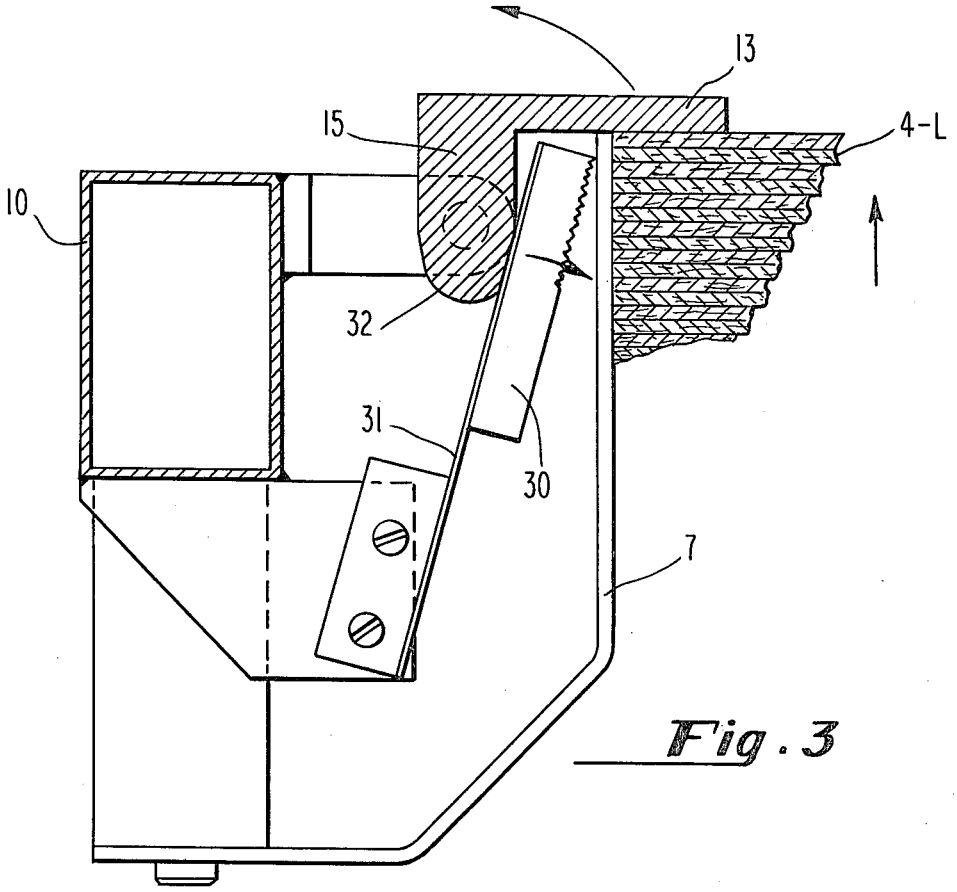
FIG. 3 is an enlarged fragmentary view taken along the lines 3—3 of FIG. 1 and illustrating the positions of restrainers with the lead carton in the take-down plane.
Figure 4:
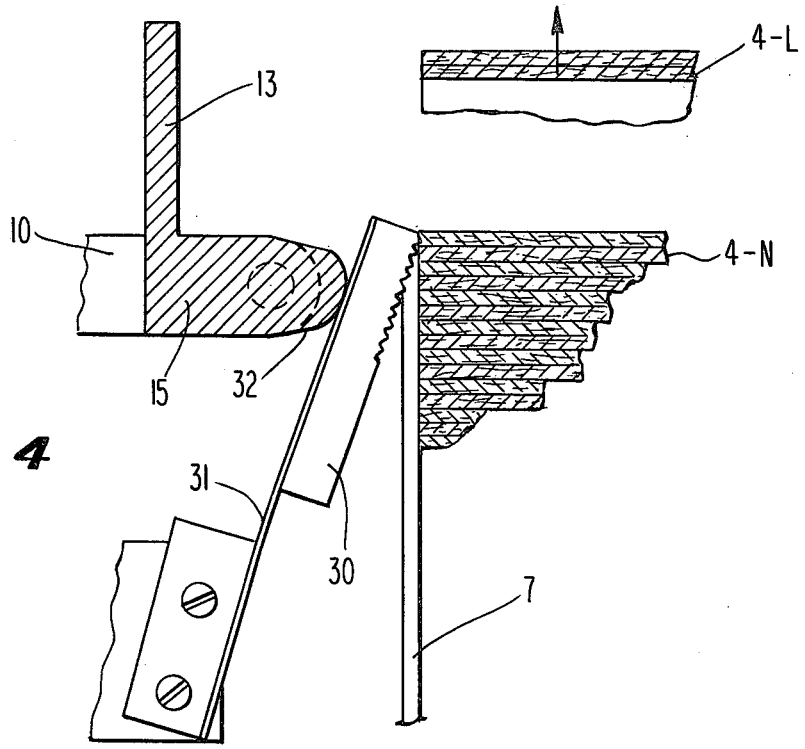
FIG. 4 is a view similar to FIG. 3 illustrating the positions of the restrainers as the take-down operation commences.

The rotory mounting of the plates 13 and 14 provides for the same to be moved between open and closed positions, the closed position being shown in FIG. 3 and the open position being shown in FIG. 4.

In the closed position the plates 13 and 14 extend in front of the lead carton 4-L. This position prevents movement of the lead carton and the stack in the direction of the arrow 5.

When the plates 13 and 14 are in the closed position, the pressure plate and carrier belt can be jogged forward to positively erect the stack with the lead carton firm against the plates. The pressure plate then can be relaxed. Thus, the plates establish the take-down plane for lead carton. It will be apparent that the take-down plane is always located at the same position.

This fixed lead carton position is important in speeding up the operation by reducing the time cycle of the suction cups. The cups are simply brought up each time to the same point (take-down plane) and vacuum immediately applied since it is known that the lead carton will be at that point. In conventional systems, the vacuum cups are brought up to the take-down plane. Then the pressure plate and carrier urge the cartons against the vacuum cups. The cups continue waiting until a seal is made. Then the carrier and pressure plates are relaxed so as not to push the second carton thru the take-down plane as the cups remove the lead carton.

In the open position, the plates 13 and 14 are spaced away from the lead carton and the stack so as not to offer any interference with the movement of lead carton out of the take-down plane.

The restainers or plates 13 and 14 are simultaneously moved as between the open and closed positions by the air cylinders 24 and 25 respectively pivotally connected to the uprights 10 and 11 and whose double acting pistons are respectively connected to bars 15 and 16. The air is simultaneously introduced and exhausted by conventional solenoid operated valve means whose function is coodinated with the operation of the erection mechanism and magazine.

The gate of the invention has another pair of restrainer means or horizontally extending fingers which are disposed on opposite sides of the stack and adjacent the plates 13 and 14. One of the fingers is shown at 30 in FIGS. 1, 3 and 4. A similar finger is disposed on the opposite side.

The purpose of the fingers is to hold the stack firm and upright during the time the plates 13 and 14 are open and the lead carton is being taken down. Thus, the fingers are movable as between an open position as shown in FIG. 3 and a closed position as shown in FIG. 4.

In the open position the fingers are spaced away from and disengaged from the stack and thus offer no interference to the stack being moved against the plates 13 and 14.

In the closed position, the fingers are adapted normally to engage the carton 4-N next to the lead carton 4-L. At this time, there is no forward pressure being exerted by the pressure plate. The only forward pressure comes from the natural tendency for the stack to expand after being compressed against the plates 13 and 14 at the time the lead carton is put into the take-down plane. The fingers restrain any forward motion of the carton 4-N and thus prevents the carton 4-N and the carton behind same from popping out of the stack.

For additional restraining force, the fingers can be dimensioned so that in the closed position they engage the trailing bottom flap of the lead carton. This will ensure that more of each finger extends over and in front of the carton 4-N. The foregoing does not interfere with the take-down of the lead carton nor cause the same to rip in as much as the bottom flap will bend around the score line as the carton is pulled away by the suction cups.

The action of the plates and fingers is coordinated so that the fingers move to the closed position when the plates commence to move to the open position and for the fingers to move to the open position when the plates have moved substantially to the closed position; this is explained below in connection with FIGS. 2 and 3.

The finger 30 is secured to a flexible strap 31 fixedly mounted on the upright 10. The flexibility of the strap permits the finger to move in a horizontal plane as between the open and closed positions. The finger on the opposite side is similarly mounted.

A cam 32 formed on the bar 15 engages the strap 31. When the plate 13 is in the closed position, the cam 32 is engaged with the strap so that it assumes its normal un-flexed condition and the finger 30 is in the open position.

As the plate 33 starts to move to its open position, the cam (rotating with the plate) starts to push the flexible finger inwardly. The finger almost immediately engages the carton 4-N and remains engaged as the plate 13 moves to its fully open position.

During the foregoing period the suction cups have moved up into engagement with the lead carton 4-L and have started to take-down the same (see FIG. 4).

On the opposite side of the stack, the plate 14 and the finger-cam units are simultaneously and correspondingly operating.

With the carton 4-N restrained, only the lead carton 4-L will participate in the take-down operation, and thus jam-ups due to plural cartons are eliminated.

It will be understood that motion of the plates and fingers occurs in a fraction of a second.

After the take-down, the plates 13 and 14 are moved to closed position and the fingers 30 are moved to open position. As the plates move from open to closed, the cams hold the fingers against the carton 4-N until the plates have rotated about 45° and then the fingers disengage from the carton 4-N and move back to the open position. The plates move quickly into the closed position and therefore allow no time for the stack to expand and move the carton 4-N out thru the take-down station.

As soon as the plates 13 and 14 are in closed position the pressure plate and carrier are jogged to move the carton 4-N into the take-down plane. The cycle described above repeats itself.

In as much as either the plates or the fingers restrain the cartons, the chances of an attendant during a magazine reloading operation inadvertently pushing the lead carton and others thru the take-down plane is eliminated.

We claim:

1. In a carton erecting machine having frame means mounting a magazine supporting a stack of vertically oriented, flat folded cartons arranged one beside the other along an axis, the magazine including means to move and guide the cartons one after another to a take-down station, improved gate mechanism to releasably retain a carton in the take-down plane comprising;

a first pair of spaced apart restrainer means, said spacing providing for the pair to be respectively disposed on opposite sides of said stack;

for each first restrainer means, means mounting the first restrainer means on the machine frame for movement as between an open and closed position;

means to move said first restrainer means simultaneously to the open position or to the closed position;

in its closed position, each first restrainer means extending in front of the lead carton of the stack whereby to restrain motion of same and to locate the lead carton in a take-down plane at said take-down station;

in its open position, each first restrainer means being spaced away from the lead carton so as not to intefere with the movement of the lead carton out of the take-down plane for the erection operation;

a second pair of restrainer means respectively disposed adjacent said first restrainer means on opposite sides of said stack;

for each second restrainer means, means mounting the second restrainer means on the machine frame for movement as between an open and a closed position;

means to move said second restrainer means simultaneously to the open position or to the closed position;

in its closed position, each second restrainer means engaging the stack whereby to restrain the carton next to the lead carton from popping out of said stack;

in its open position, each second restrainer means being spaced away and the disengaged from said stack; and mechanism connected between said means to move said first restrainer means and said means to move said second restrainer means, the mechanism providing for said second restrainer means to move to the closed position when said first restrainer means commerces to move to the open position and for said second restrainer means to move the open position when said first restrainer means has moved substantially to its closed position.

2. The gate mechanism of claim 1 wherein:

each said first restrainer means is an elongated, vertically extending plate mounted for rotary motion about a vertical axis; and each said second restrainer means is an elogated finger mounted for reciprocating motion in a horizontal plane.

3. The gate mechanism of claim 2 wherein:

each means mounting a finger on the machine is a flexible strap fixed to the frame and carrying the finger; and wherein said mechanism comprises said flexible strap and cam means connected to and movable with the adjacent plate to engage and move the strap and finger to the open and closed position thereof.

4. The gate mechanism of claim 2 wherein each finger has serrations for engaging a carton.

5. In a carton erecting machine having frame means mounting a magazine supporting a stack of vertically oriented, flat folded cartons arranged one beside the other along an axis, the magazine including means to move and guide the cartons one after another to a take-down station, improved gate mechanism to releasably retain a carton in the take-down plane comprising;

first and second carton restrainer means, each mounted to be moved as between open and closed positions;

means to move said first and second restrainer means so that when the first restrainer means is in the closed position the second restrainer means is in the open position and when the first restrainer means is in the open position the second restrainer means is in the closed position;

in the respective open positions each restrainer means being disengaged and spaced from the cartons of the stack;

in the closed position of the first restrainer means, the first restrainer means engaging the lead carton of the stack whereby to restrain motion of same and to locate the lead carton in a take-down plane at said take-down station; and in the closed position of the second means, the second means engaging the stack whereby to restrain the carton next to the lead carton from popping out of the stack when the lead carton is taken down for the erection operation.

* * * * *